US006452346B1

(12) United States Patent
Sluyterman et al.

(10) Patent No.: US 6,452,346 B1
(45) Date of Patent: Sep. 17, 2002

(54) COLOR DISPLAY DEVICE WITH DEFLECTION MEANS AND A CO-OPERATING PAIR OF MEANS FOR INFLUENCING THE DISTANCE BETWEEN ELECTRON BEAMS

(75) Inventors: Albertus Aemilius Seyno Sluyterman; Steven Ruiter, both of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/689,057

(22) Filed: Oct. 12, 2000

(30) Foreign Application Priority Data

Oct. 15, 1999 (EP) ..... 99203392

(51) Int. Cl.[7] ..... G09G 1/04

(52) U.S. Cl. ..... 315/369; 315/368.18; 315/368.28; 315/411

(58) Field of Search ..... 315/364, 368.13, 315/368.18, 368.27, 368.28, 369, 371, 403, 411

(56) References Cited

U.S. PATENT DOCUMENTS

| | | | | | |
|---|---|---|---|---|---|
| 3,968,402 | A | * | 7/1976 | Sahara et al. | 315/370 |
| 4,401,922 | A | * | 8/1983 | Kamata et al. | 315/368 |
| 4,864,195 | A | * | 9/1989 | Masterton | 315/371 |
| 4,988,926 | A | * | 1/1991 | Sluyterman et al. | 315/368 |
| 5,027,042 | A | * | 6/1991 | Sluyterman et al. | 315/368 |
| 5,248,920 | A | * | 9/1993 | Gioia et al. | 315/368.26 |
| 5,828,167 | A | * | 10/1998 | Jitsukata et al. | 313/412 |

FOREIGN PATENT DOCUMENTS

WO WO9934392 7/1999

* cited by examiner

*Primary Examiner*—Haissa Philogene

(57) ABSTRACT

A color cathode ray tube has quadrupole elements which increase and decrease the distance between the electron beams as a function of the deflection. Two co-operating elements have their windings connected in series with each other to minimize dissipation in the driving circuits. One driving circuit provides a common current which flows through both quadrupole elements, while another driving circuit provides a difference current to a node between the quadrupole elements.

2 Claims, 4 Drawing Sheets

COLOR DISPLAY DEVICE WITH DEFLECTION MEANS AND A CO-OPERATING PAIR OF MEANS FOR INFLUENCING THE DISTANCE BETWEEN ELECTRON BEAMS

BACKGROUND OF THE INVENTION

The invention relates to a color display device.

Such a device is known from PCT-application no. WO 99/34392-A1. The known device comprises a color cathode ray tube with an in-line electron gun for generating three electron beams, a color selection electrode and a phosphor screen on an inner surface of a display window, and a deflection unit for deflecting the electron beams across a color selection electrode. The known device also comprises a pair of means, which are arranged at some distance from each other and are intended to dynamically influence the trajectories of the electron beams so as to decrease the distance between the electron beams at the location of the deflection plane as a function of the deflection. By doing so, the distance between the electron beams decreases for larger deflection angles. The distance between the color selection electrode and the phosphor screen is inversely dependent on the distance between the electron beams. Thus a decrease of the distance between the electron beams enables the distance between the color selection electrode and the phosphor screen to be increased. This makes it possible to combine a flat or almost flat display screen with a color selection electrode having a larger curvature. Said larger curvature increases the strength of the color selection electrode and reduces doming and microphonics. The color selection electrode may be a shadow mask.

Although the known device operates satisfactorily, problems remain. Power consumption of the pair of co-operating means poses a problem, more particularly the power dissipation in the drive circuit(s) for the co-operating means.

BRIEF SUMMARY OF THE INVENTION

It is an object of the invention to provide a color display device of the opening paragraph with reduced power needs.

To this end, an aspect of the invention provides a color displays device as defined in claim 1.

The co-operating means are not directly driven by the rectified vertical deflection current as shown in FIG. 5 of WO 99/34392-A1 (see also FIG. 3 of this application). Such direct driving has the disadvantage that the co-operating; means draw their power directly from the deflection circuit and are coupled directly to the deflection circuit. The current through the co-operating means cannot be more than the current through the deflection circuit, putting a limit on the available current through the co-operating means and also on the shape and form of the current. If the current through the co-operating means is to be smaller than the deflection current, a part of the deflection current will have to be bypassed, inevitably leading to power loss. Furthermore, differences in temperature between the co-operating means and the bypass will lead to fluctuations in the current through the co-operating means, resulting in fluctuations and temperature instability.

In the color display device in accordance with the invention, the color display device is provided with driving means having an input for a signal corresponding to the deflection current. The deflection current itself does not directly drive the co-operating means, eliminating or at least strongly reducing the problems described above. A signal corresponding to the deflection current could be, for instance, a voltage across a resistive or capacitive element through which the deflection current or a part of the deflection current runs.

The two co-operating means are arranged in series. As was found by the inventors, the supply voltage commonly used in sets for functioning of the co-operating means is high in relation to the impedance of the co-operating means. The current through the means is also rather high. As a result, when the two co-operating means are driven separately or in parallel, much power is dissipated in the driving circuit for the co-operating means.

By putting the two co-operating means in series, the power need for the cooperating means is reduced, and particularly the drive voltage for the co-operating means can be made to match the supply voltage for the driving circuit.

However, when the two co-operating means are arranged in series, problems arise due to the fact that, although the two co-operating means provide magnetic fields of similar strength and form and are often very similar or even equivalent in design, they can best be supplied with different currents. By supplying the difference to a node (connection point) in between the two co-operating means, the operation of the co-operating means is greatly improved without increasing the power requirements to a large degree.

These and other objects of the invention are apparent from and will be elucidated with reference to the embodiments described hereinafter.

DETAILED DESCRIPTION OF THE INVENTION

Figure 1:
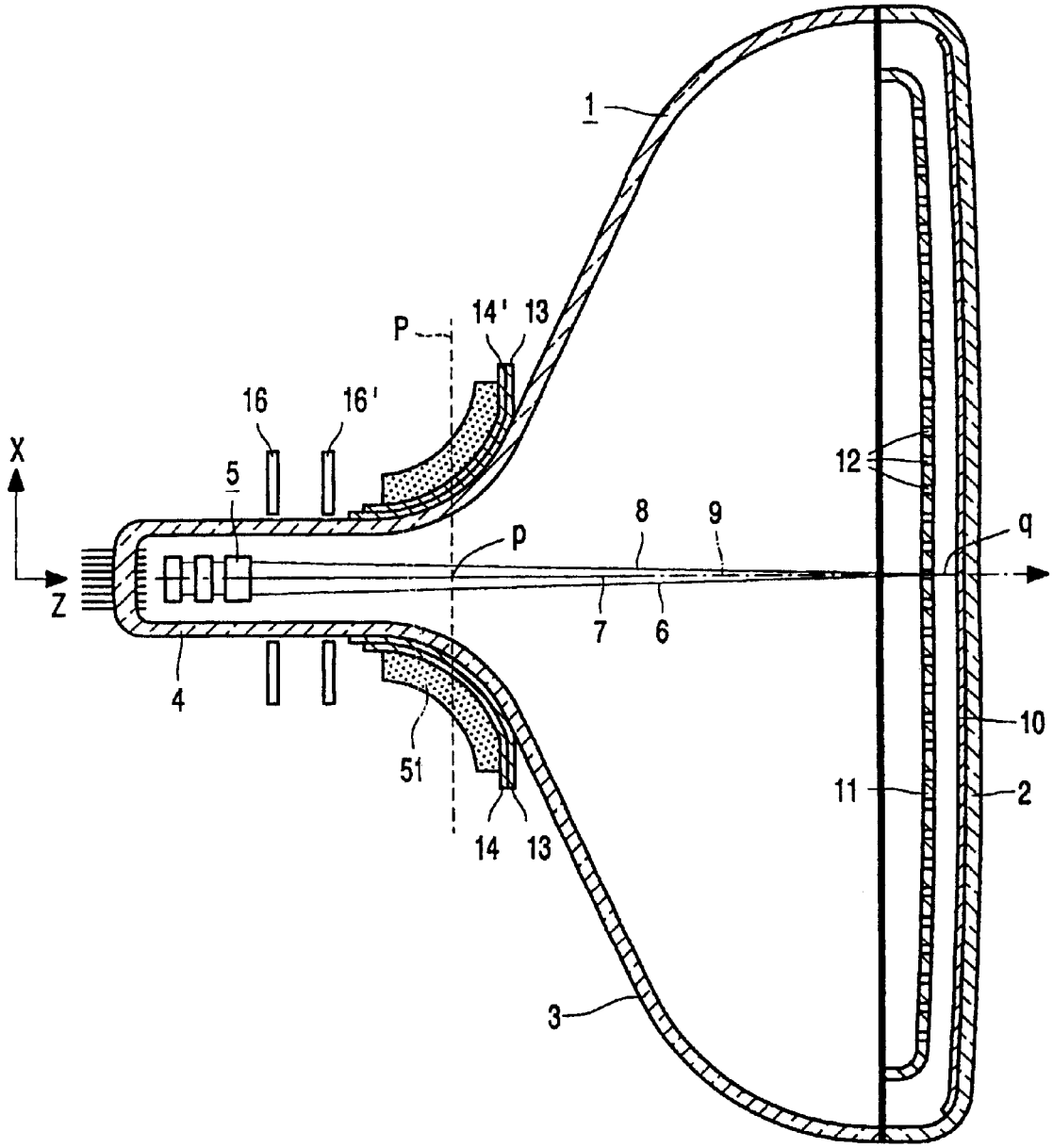
FIG. 1 PRIOR ART
FIG. 1 is a sectional view of a display device, in which the invention is schematically shown.

The Figures are not drawn to scale. In the Figures, like reference numerals generally refer to like parts.

The color display device comprises a color cathode ray tube having an evacuated envelope 1, which includes a display window 2, a cone portion 3, and a neck 4. The neck 4 accommodates an electron gun 5 for generating three electron beams 6, 7 and 8 which extend in one plane, the in-line plane, which in this example is in the plane of the drawing. In the undeflected state, the central electron beam 7 substantially coincides with the tube axis 9. The inner surface 10 comprises a large number of phosphor elements luminescing in red, green and blue. On their way to the display screen, the electron beams are deflected across the display screen 10 by means of an electromagnetic deflection unit 51 and pass through a color selection electrode 11 which is arranged in front of the display window 2 and comprises a thin plate having apertures 12. The three electron beams 6, 7 and 8 pass through the apertures 12 of the color selection electrode at a small angle relative to each other and hence each electron beam impinges only on phosphor elements of one color. In addition to a coil holder, the deflection unit 51 comprises coils 13 and 14 for deflecting the electron beams in two mutually perpendicular directions. The display device further includes means for generating voltages which, during operation, are fed to components of the electron gun via feedthroughs. The deflection plane P is schematically indicated as well as the distance p between the outer electron beams 6 and 8 in this plane, and the distance q between the color selection electrode and the display screen.

Figure 2A:
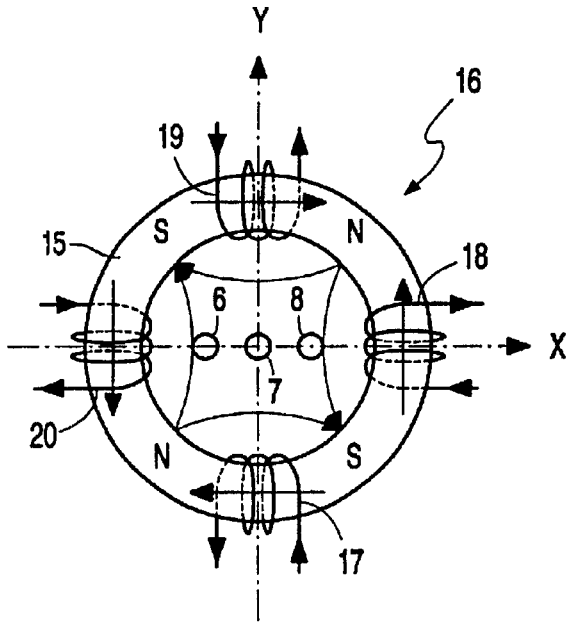
FIG. 2A PRIOR ART
FIGS. 2A and 2B show schematically a number of quadrupole elements.
Figure 2B:
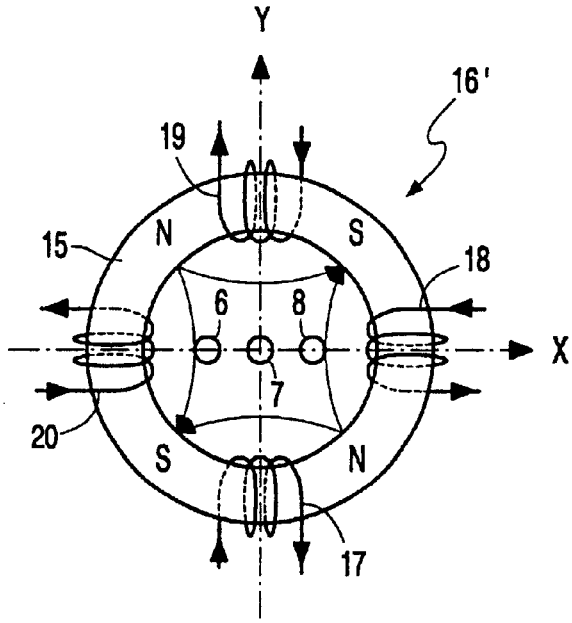
FIG. 2B PRIOR ART

The color display device comprises two co-operating means 16 and 16', a first means being used, in operation, to dynamically bend, i.e. as a function of the deflection in a direction, the outermost electron beams more towards each other as a function of the deflection (as a function of the position of the beams in the window), and a second means 16' which serves to dynamically bend the outermost beams in opposite directions as a function of the deflection. FIGS. 2A and 2B show examples of such means. In this case, means 16 (FIG. 2A) comprises a ring core of magnetizable material on which four coils 17, 18, 19 and 20 are wound in such a manner that, upon excitation, a 45° quadrupole field is generated. A 45° quadrupole field can alternatively be generated by means of two wound C-cores or by means of a stator construction. The construction of 16' (FIG. 2B) is comparable to that of means 16. However, the coils are wound in such a manner, and the direction in which, in operation, current passes through the coils is such that a 45° quadrupole field is generated having an orientation which is opposite to that of the 45° quadrupole field shown in FIG. 2A.

The three electron beams are separated from each other in the plane of deflection P (a plane in which the z-position is situated approximately in the center of the deflection unit 11) by a distance p (see FIG. 1). The distance q between the color selection electrode 12 and the display screen 10 is inversely proportional to the distance p.

Figure 3:
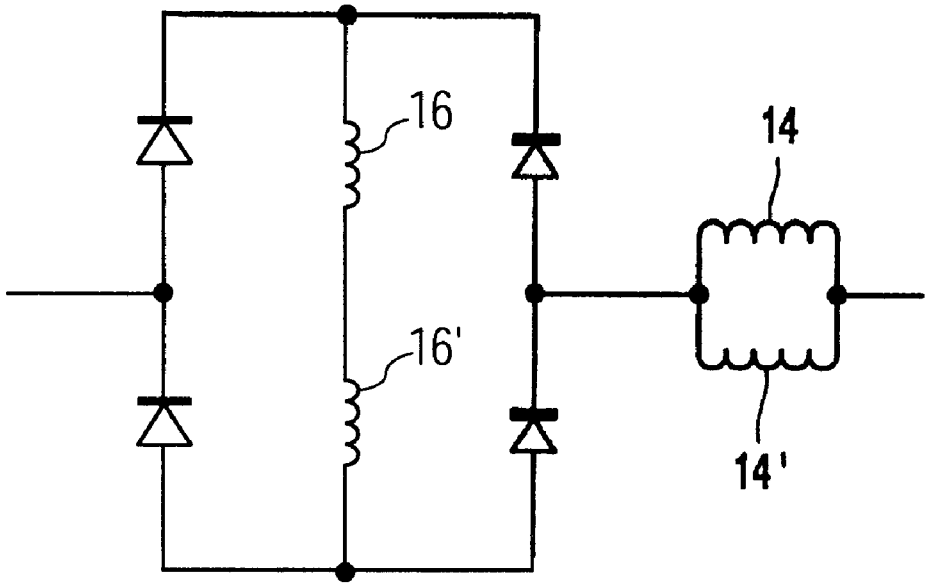
FIG. 3 PRIOR ART
FIG. 3 shows a known arrangement.

The means 16, 16' are to be supplied with current. The inventors have found that the effects of errors in driving currents add up if the co-operating means are driven in parallel, while the effects of errors in driving current (at least in a first order approximation) cancel each other if the co-operating means are driven in series. Furthermore, as compared with driving in parallel, driving in a series arrangement reduces the power dissipated in the driving means. FIG. 3 shows schematically an arrangement for supplying current to the means 16, 16' as known from FIG. 5 of WO 99/34392-A1. The current through the coils 14, 14' is rectified and sent through the means 16, 16'. The means 16, 16' are thus directly coupled to the coils 14, 14' and draws its power directly from the current through the deflection coils. This has a number of shortcomings as described above. The current through the co-operating means cannot be more than the current through the coils 14, 14'. If the current has to be smaller, part of the deflection current must bypass the co-operating means 16, 16', leading to a loss of power. In operation, the coils 14, 14' and the means 16, 16' are subject to substantial temperature changes which may have a negative influence on the function of both coils 14, 14' (and thus on the deflection of the electron beams) of cooperating means 16, 16'. In this example, the latter means 16' are shown as means which are separate from the deflection unit, but they could be integrated in the deflection unit, for instance, wound on or around the core of the deflection unit.

Apart from the problems already mentioned in relation to temperature fluctuations, the inventors have also realized the following.

The effect of the fields on the electron beams is dependent on the position of the electron beams in said field. Therefore, the effect to be used in the second co-operating means is dependent on the effect on the first operating means. This can best be explained by the following example.

Let it be assumed that both co-operating means have the same design and the same current is driven through them, and the spatial configuration and strength of the fields are the same but of opposite sign.

When no current is driven through the co-operating means, the field in both means is zero and the effect of each field and the total effect is zero. When a small current is driven through means 16 and 16', the small field in means 16 will cause a slight change in the position of the electron beams in co-operating means 16'. The effect of the field in co-operating means 16' will be slightly different due to the fact that the position of the electron beams in the co-operating means is not the same. The counteracting effect of means 16' will thus be smaller or larger than the effect of means 16. As the currents increase and the field strengths increase, this effect will become greater and greater. Thus, whereas the currents through the two co-operating means can be the same in the case of small currents, the two means can best be supplied with different currents in the case of larger currents. The current through the co-operating means preferably varies from a value for zero deflection to a value of opposite sign for maximum deflection. It also follows from the above explanation that the means can best be driven with currents which deviate from zero as little as possible. Compared to devices in which the current is zero for zero deflection, the current varying from a value for zero deflection to a value of opposite sign for maximum deflection reduces the maximum currents through the means 16, 16'. The larger the currents, the larger the difference current. Driving a common current through the series arrangement and driving a difference current through one of the co-operating means enables a better image quality to be obtained. Generally speaking, any error in the common current $I_c$ has little effect on the image quality, because in a first order approximation, the separate effects in means 16 and 16' cancel each other. An error in the difference signal also has relatively little influence, because it is an error in a difference, thus a second-order effect.

Figure 4:
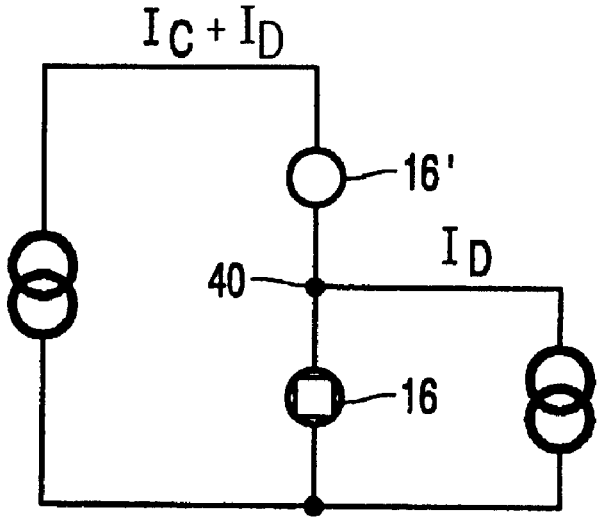
FIGS. 4 and 5 illustrate schematically a means for supplying current for a color display device in accordance with the invention.

FIG. 4 shows schematically the driving scheme for the co-operating means in a device in accordance with the invention. The co-operating means 16, 16' are arranged in series and a common current $I_C$ is driven through them. A difference current $I_D$ is supplied at a node 40.

Figure 5:
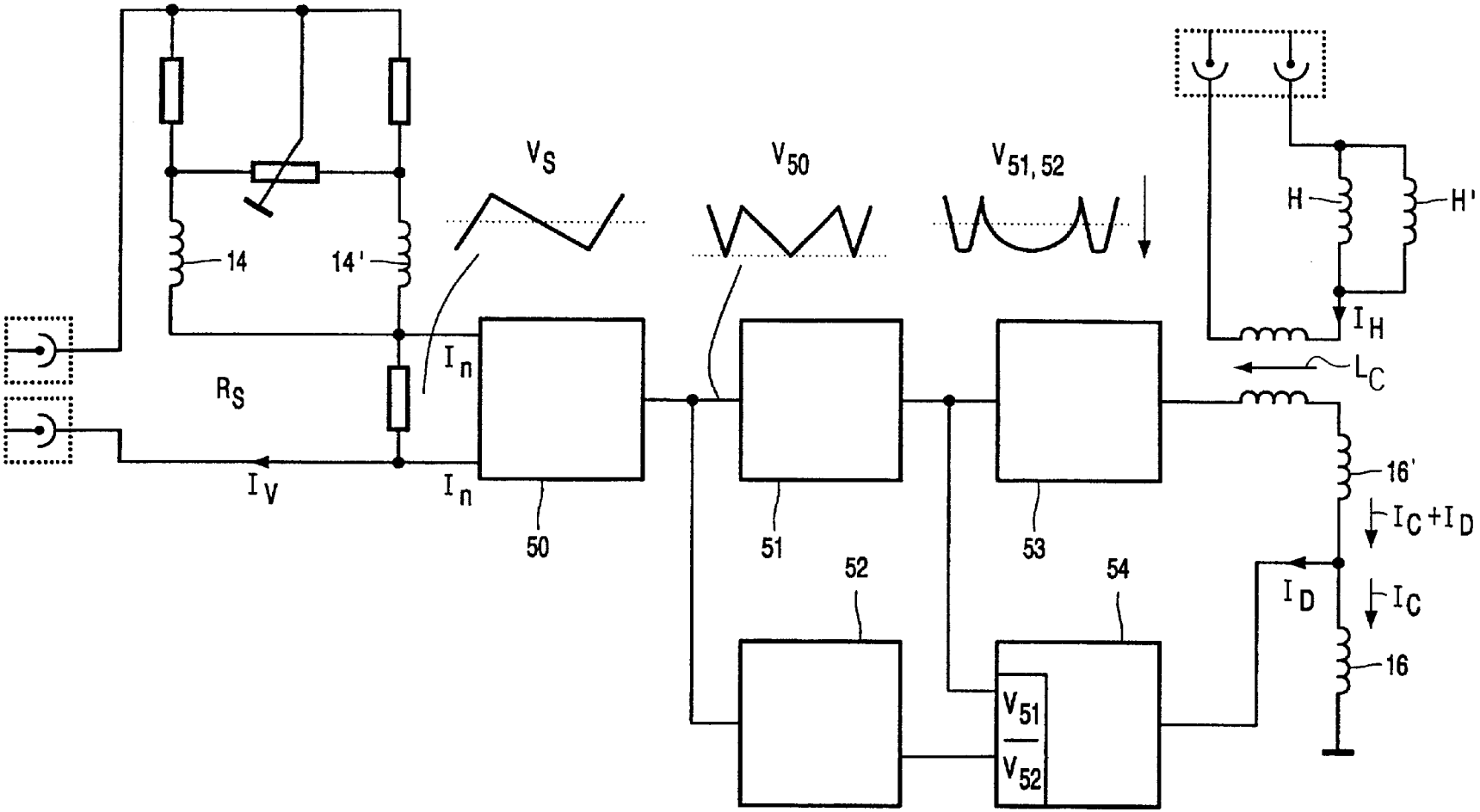

FIG. 5 shows schematically more details of a device in accordance with the invention. A vertical deflection current $I_v$ is driven through vertical deflection coils 14, 14'. This current generates a voltage signal $V_S$ across resistive element $R_S$. This voltage $V_s$ is schematically indicated in the Figure above part 50. This signal voltage is led to input $I_n$ of part 50 of the driving means in which the signal is amplified and rectified. The resulting rectified voltage signal $V_{50}$ is indicated in the Figure above the space between parts 50 and 51, 52. This rectified signal is applied to parts 51 and 52, in which parts the signal is wave-shaped, making the signal dependent on the square of the current rather than on the current (or on any other combinations of powers of the current) and is shifted, i.e. in this example causing the signal to fluctuate around zero instead of always being positive. The maximum current through means 16, 16' is thereby limited, also reducing the difference current. The resulting voltages $V_{51,52}$ are indicated in the Figure. By selection of small differences in the amplification and phase shift in circuits 51 and 52, the two wave-shaped and shifted signals are slightly different in amplitude, shape and form. Signal $V_{51}$ is applied across the series arrangement 16, 16', while the difference current is drawn by circuit 54 from the node between means 16 and 16'. As a result, only the common current flows through means 16. In this example, the driving means also comprises a coupling $L_C$. The horizontal deflection coils H, H' are driven by a current $I_H$. By coupling this current through coupling $L_C$, the currents through 16, 16' are made dependent on the horizontal deflection current, i.e. the horizontal position of the electron beams on the display screen.

Parts 53 and 54 are driving circuits for the quadrupole elements 16' and 16 respectively. Part 53 provides a drive voltage for the two quadrupole elements, with a peak close to the supply voltage. Feedback of a current proportional to the horizontal deflection current provides a signal which modifies the current through the quadrupole windings proportional to the horizontal deflection. Part 54 has a relatively low average power because its output current is only the difference between the net currents in the two quadrupole elements.

In summary, the invention can be described as follows.

A color display device (1) comprises a deflection unit with deflection coils 14, 14' and electromagnetic co-operating means 16, 16'. The co-operating means increase and decrease the distance between the electron beams as a function of the deflection. The co-operating means 16, 16' are arranged in series. Means are provided to supply the series arrangement of the co-operating means with a common current $I_c$ and to supply a difference signal $I_D$ to a node in between the two co-operating means.

It will be evident that many variations are possible within the scope of the invention.

What is claimed is:

1. A color display device comprising a color cathode ray tube with an in-line electron gun for generating three electron beams, a deflection means for generating a deflection current to deflect the electron beams, a pair of co-operating electromagnetic means for generating magnetic fields for dynamically influencing the distance between electron beams as a function of the deflection, and driving means for supplying current to the co-operating means, characterized in that said driving means have an input for an input signal corresponding to the deflection current, the two co-operating means are electrically arranged in series, and the driving means comprise:

means for deriving a common driving signal from the input signal and for supplying the common driving signal to the series arrangement of the two co-operating means, and means for deriving a difference driving signal from the input signal and for supplying the difference driving signal to a node in the series arrangement of the two co-operating means at a position between the two co-operating means.

2. A device as claimed in claim 1, characterized in that, in operation, the means for deriving a common driving signal provide a common driving signal through the co-operating means, said signal varying from a value for zero deflection to a value of opposite sign for maximum deflection.

* * * * *